US012773758B2

(12) United States Patent
Kelley et al.

(10) Patent No.: US 12,773,758 B2
(45) Date of Patent: Oct. 27, 2026

(54) MASTIC CONCRETE COATING REMOVAL TOOL

(71) Applicant: THE MALISH CORPORATION, Mentor, OH (US)

(72) Inventors: Patrick Kelley, Willoughby, OH (US); Jon Love, Ashtabula, OH (US)

(73) Assignee: THE MALISH CORPORATION, Mentor, OH (US)

( * ) Notice: Subject to any disclaimer, the term of this patent is extended or adjusted under 35 U.S.C. 154(b) by 320 days.

(21) Appl. No.: 18/563,176

(22) PCT Filed: May 20, 2022

(86) PCT No.: PCT/US2022/072459

§ 371 (c)(1),
(2) Date: Nov. 21, 2023

(87) PCT Pub. No.: WO2022/251798

PCT Pub. Date: Dec. 1, 2022

(65) Prior Publication Data

US 2024/0253186 A1 Aug. 1, 2024

Related U.S. Application Data

(60) Provisional application No. 63/192,235, filed on May 24, 2021.

(51) Int. Cl.
*B24D 7/06* (2006.01)
*B24B 7/18* (2006.01)

(52) U.S. Cl.
CPC ..... *B24D 7/066* (2013.01); *B24B 7/186* (2013.01)

(58) Field of Classification Search
CPC . B24D 7/066; B24D 5/00; B24D 5/06; B24D 5/16; B24D 7/00; B24D 7/06;
(Continued)

(56) References Cited

U.S. PATENT DOCUMENTS 2,860,506 A * 11/1958 Drummond ..... E04F 21/08 404/112
7,081,047 B2 7/2006 Palushaj
(Continued)

FOREIGN PATENT DOCUMENTS

KR 20110056043 A * 5/2011 ..... B24D 3/10
KR 20110080794 A 7/2011
(Continued)

OTHER PUBLICATIONS

Extended European Search Report issued Mar. 3, 2025, in European Patent No. 22812365.9, 8 pages.
(Continued)

*Primary Examiner* — Carlos A. Rivera
(74) *Attorney, Agent, or Firm* — Vorys, Sater, Seymour and Pease LLP; Rex W. Miller, II

(57) ABSTRACT

A tool for a floor machine. The tool includes a base having a plurality of slots, and a cleaning element provided in each of the slots. The cleaning elements are oriented along a secant or chord of the base. The cleaning elements have abrasive portions with abrasive grit thereon, and may be non-planar at least at a portion of the abrasive portion.

19 Claims, 4 Drawing Sheets

(58) Field of Classification Search
CPC ..... B24D 7/16; B24D 7/186; B24D 41/00; B24D 41/02; B24D 41/04; B24D 41/047
See application file for complete search history.

(56) References Cited

U.S. PATENT DOCUMENTS

| | | | | |
|---|---|---|---|---|
| 7,144,194 | B2 * | 12/2006 | Kipp, Jr. | E04F 21/248 404/112 |
| 7,690,970 | B2 * | 4/2010 | Palushaj | B24B 7/186 451/353 |
| D632,537 | S | 2/2011 | Palushaj | |
| 7,988,539 | B2 | 8/2011 | Palushaj | |
| 8,043,144 | B2 | 10/2011 | Palushaj | |
| 8,105,134 | B2 | 1/2012 | Palushaj | |
| 9,102,029 | B2 | 8/2015 | Palushaj | |
| 9,492,909 | B2 | 11/2016 | Palushaj | |
| 9,776,305 | B2 | 10/2017 | Palushaj | |
| 9,796,067 | B2 | 10/2017 | Palushaj | |
| 9,950,408 | B2 | 4/2018 | Palushaj et al. | |
| D834,074 | S | 11/2018 | Palushaj et al. | |
| 10,213,891 | B2 | 2/2019 | Palushaj | |
| 10,849,660 | B2 | 12/2020 | Palushaj | |
| 2007/0254568 | A1 | 11/2007 | Park | |
| 2009/0221212 | A1 | 9/2009 | Palushaj | |
| 2021/0053188 | A1 | 2/2021 | Palushaj | |

FOREIGN PATENT DOCUMENTS

| | | | | |
|---|---|---|---|---|
| KR | 20150116263 A | * | 10/2015 | B24D 13/14 |
| WO | 2008142544 A1 | | 11/2008 | |

OTHER PUBLICATIONS

International Search Report and Written Opinion issued Aug. 11, 2022 in International Application No. PCT/US2022/072459, 18 pages.

* cited by examiner

MASTIC CONCRETE COATING REMOVAL TOOL

RELATED APPLICATIONS

This application is a national stage of International Patent Application PCT/US2022/072459 filed May 20, 2022, which claims priority benefit of U.S. Provisional Patent Application Ser. No. 63/192,235 filed May 24, 2021, entitled "Mastic Concrete Coating Removal Tool," the complete disclosure of which, in their entirety are herein incorporated by reference.

BACKGROUND

Concrete or cement is a very popular material for use in floors and construction materials because of its strength, durability and low costs. However, if the concrete or cement is left unfinished, the concrete floor will accumulate and produce dust by the constant scuffing incurs via use, such as via foot traffic or wheeled traffic. In addition, the unfinished concrete or cement floor is susceptible to staining due to porosity. Also, some concrete or cement floors have mastic or older plastic and paints previously coated thereon. Thus, a tool is needed for effectively sanding such unfinished concrete or cement that is capable of removing mastic or older plastic and paints previously coated thereon.

SUMMARY

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

In accordance with one aspect of the present disclosure, a tool for a floor machine is describe. The tool for a floor machine includes a base having an upper side attachable to the floor machine and a lower side opposite the upper side. The base includes a plurality of slots extending from a periphery of the base inward therefrom along a secant of the base. A cleaning element is provided within each of the slots, the cleaning elements each having an abrasive portion with abrasive material provided thereon. In a further embodiment, at least a portion of the abrasive portion is non-planar. In another further embodiment, the cleaning elements each include a mounting portion attachable to the base and an abrasive portion extending from the mounting portion at an angle. In another further embodiment, the mounting portion is attached to the upper surface of the base. In another further embodiment, the at least a portion of the abrasive portion is non-planar is a convex curvature facing a direction of rotation of the tool.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to floor treatment and preparation devices and tools and, more particularly, to tools that can be used to remove coatings from floor surfaces such as concrete.

Figure 1:
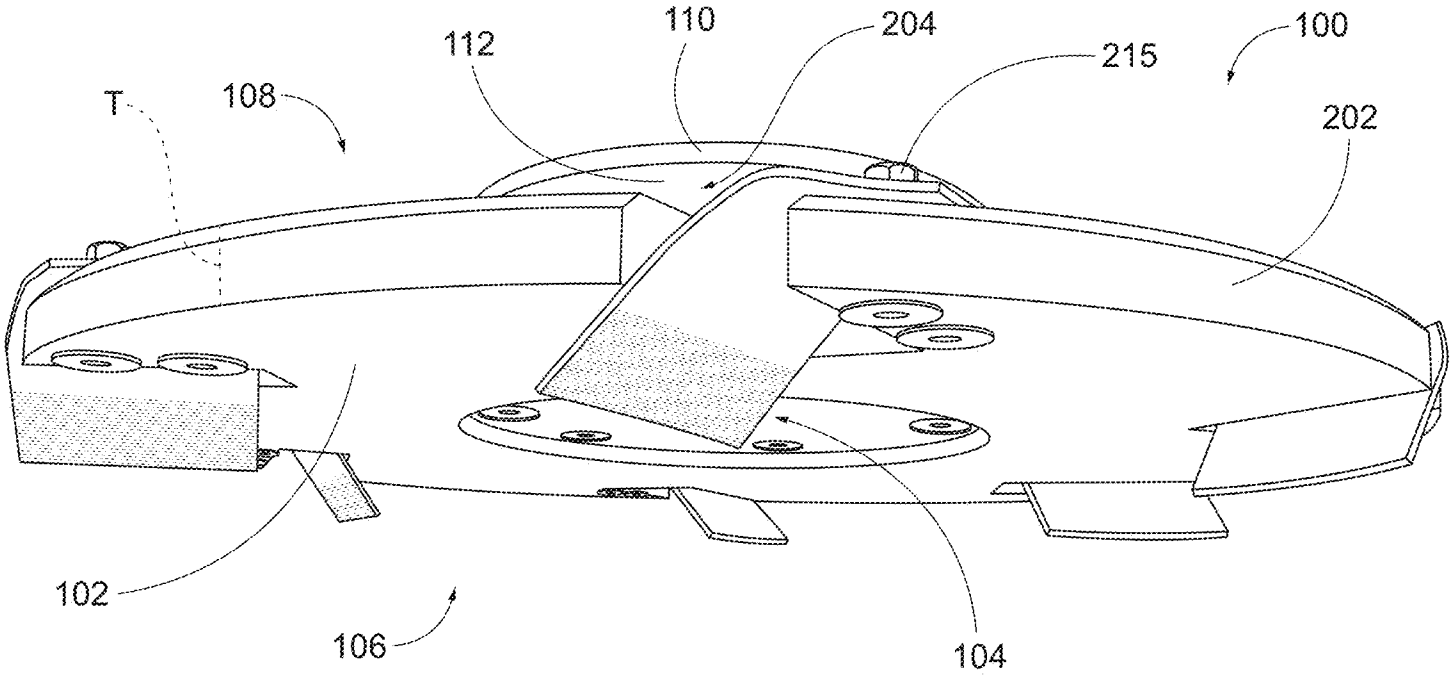
FIG. 1 is an isometric view of an example tool according to one or more embodiments of the present disclosure.

FIG. 1 is an isometric view of an example tool assembly 100 that may incorporate the principles of the present disclosure. The depicted tool assembly 100 is just one example tool assembly that can suitably incorporate the principles of the present disclosure. Indeed, many alternative designs and configurations of the tool assembly 100 may be employed, without departing from the scope of this disclosure.

As illustrated, the tool assembly 100 (hereinafter, the tool 100) includes a base (or housing) 102 and a plurality of cleaning elements 104 (or blades 104). The base 102 is circular in shape and configured for attachment to a rotary cleaning/polishing machine whereby the tool 100 is rotated in a clockwise or counter clockwise direction. In the illustrated example, the tool 100 is configured for counter-clockwise rotational operation however, it will be appreciated that the tool 100 may instead be configured for clockwise rotational operation without departing from the present disclosure.

The base 102 includes a bottom side 106 and an upper side 108. The cleaning elements 104 are attached to the base 102 such that they extend downward from the bottom side 106 and, in this manner, the bottom side 106 is configured for cleaning, preparing, abrading, etc. a floor surface. The upper side 108 of the base is configured for attachment to the floor machine. Thus, for example, a clutch plate may be provided on the upper surface 108 of the base 102 whereby the clutch plate couples the base 102 to the floor machine. Also, one or more additional components may be provided for helping or facilitating attachment of the tool 100 to a particular type of floor machine. For example, a riser (not illustrated) may be provided on the upper surface 108 of the base 102 and extend upward from the uppers surface 108, and the clutch plate may be provided on an upper surface of the riser (i.e., on an end of the riser opposite the other the base 102) to provide clearance between the base 102 and the floor machine if desirable.

Figure 2:
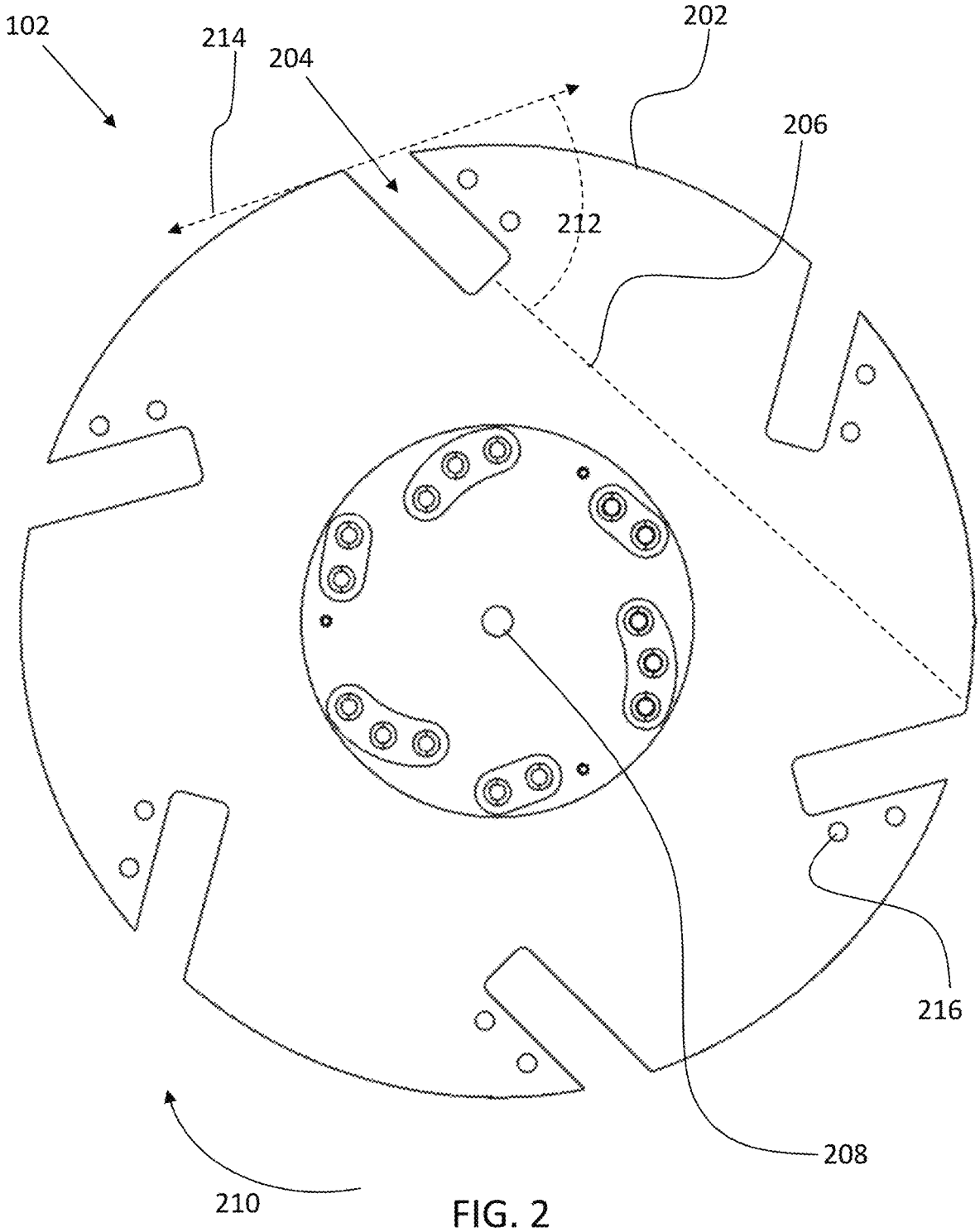
FIG. 2 illustrates an example of the housing/base utilized in the tool of FIG. 1.

FIG. 2 illustrates an example of the base 102 utilized in the tool 100 of FIG. 1. In the illustrated example, the base 102 is circular in shape (or a disc shape), and has an outer circumference or peripheral edge or sidewall 202. As shown, the base 102 includes a plurality of slots 204 formed in the base 102. The slots 204 are formed in the base 102 so as to extend inward into the base 102 from the peripheral edge 202. The slots 204 are oriented along a secant or chord 206 of the circular shaped base 102 and, in this manner do not radially align with a center point 208 of the base 102 (i.e., the slots 204 are not oriented on a radius of the base 102). Thus, the slots 204 slots extend from the peripheral edge 202 along a secant or chord of the base 102 and terminate at a location along the secant or chord that is inward or interior of the peripheral edge 202. As described below, the base 102 and the plurality of slots 204 are configured for receiving the cleaning elements 104.

The base 102 may be made from various types of material, including various thermoplastic polymers. In one example, the base 102 is a molded polypropylene. In the illustrated example, the housing 102 is configured to rotate as indicated by arrow 210 during operation; however, the base 102 may instead be configured to rotate in an opposite direction during operation and, in such examples, the slots 204 may be oppositely provided. For example, in the illustrated example, the slots 204 are oriented at an angle 212 between the chord 206 and a tangent 214 and, if the housing 102 were instead configured for rotation in a direction opposite arrow 210, such oppositely configured housing 102 may include slots oriented along a chord extending from the tangent 214 at an angle equal to one-hundred and eighty degrees (180°) minus the angle 212 (i.e., such slot would be oriented on a chord extending at an angle that is supplementary to the angle 212).

The base 102 may also include a plurality of mounting holes 216 configured for attaching the cleaning elements 104 to the base 102. As illustrated, the mounting holes 216 are provided in pairs, with each such pair of mounting holes 216 provided to receive an individual cleaning element 104. The mounting holes 216 may extend through the entire thickness T of the base 102, or they may extend into the base 102 from the upper surface thereof a distance less than the thickness T. It is to be appreciated that the configuration and number of mounting holes is not limiting and that more or less mounting holes may be provided for securing the cleaning elements 104 to the base. In other embodiments, the top surface 108 of the base 102 may include recessed portion about the slots configured to receive a portion of a cleaning element 104, such as the base portion 302 discussed in greater detail below. Attachment of the cleaning elements to the base 102 may be made via mechanical fasteners or via adhesives (e.g., epoxy).

Figure 3A:
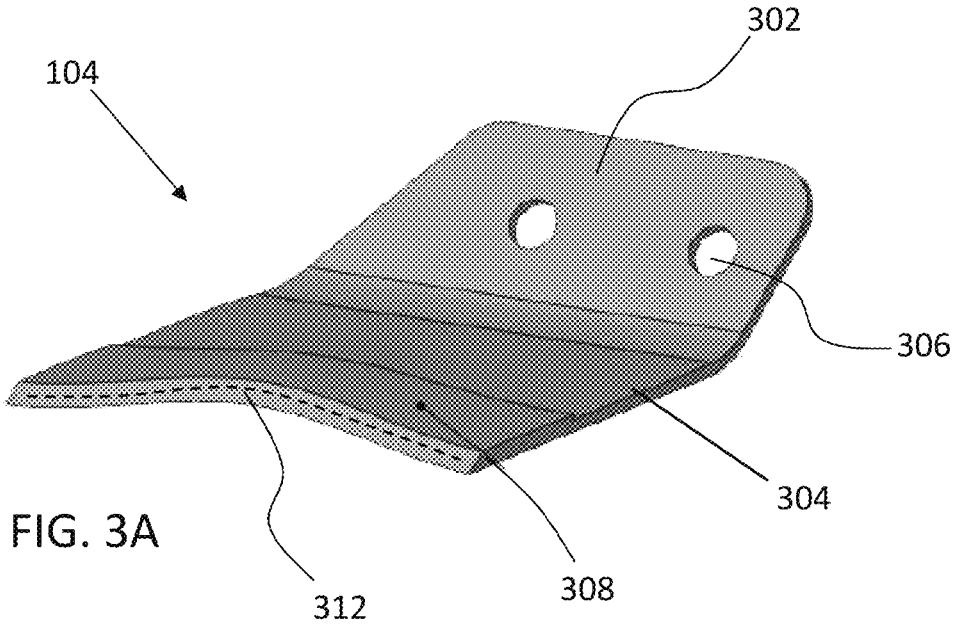
FIGS. 3A and 3B illustrate an example of the cleaning elements utilized in the tool of FIG. 1.
Figure 3B:
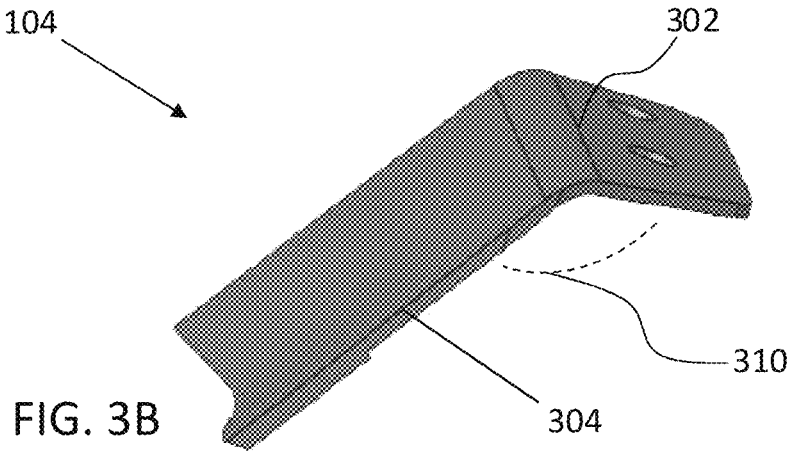
Figure 4:
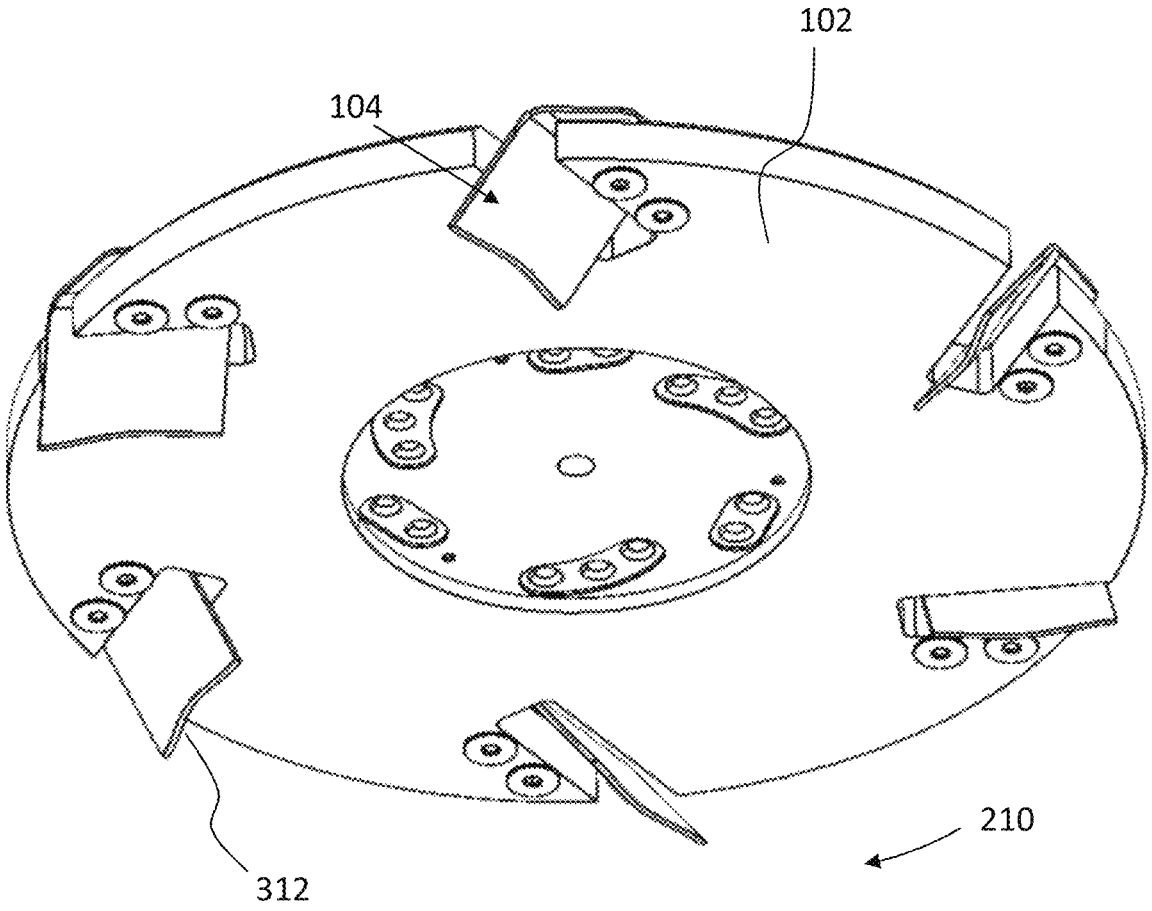
FIG. 4 is an isometric view of another example tool according to one or more embodiments of the present disclosure.

FIGS. 3A and 3B illustrate an example of the cleaning elements 104 utilized in the tool 100 as shown in FIG. 4. As shown, the cleaning element 104 may comprise a bent piece of material having a mounting base portion 302 and an abrasive portion 304 extending from the base portion 302 at an angle 310. Here, the abrasive portion 304 is angled relative to the base portion 302 at an obtuse angle 310. In some embodiments, the obtuse angle 310 is from about 100 degrees to about 150 degrees. In some preferred embodiments, the obtuse angle is about 125 degrees.

The base portion 302 is configured for attachment to the base 102. In the illustrated example, the base portion 302 includes mounting holes 306 that are alignable with corresponding mounting holes 216 on the upper surface 108 of the base, and which may receive a fastener (e.g., a threaded fastener) and thereby secure the cleaning elements 104 on the base 102.

The base portion may be substantially planer so as to match the top surface 108 of the base 102. The abrasive portion 304 of the cleaning element 104 is generally non-planar and includes a curvature 312. In particular, the face of the abrasive portion 304 includes curvature at least at a portion thereof where the abrasive material 308 is brazed thereon. The curvature 312 is a convex curvature facing the direction of travel. In this way, during abrasive contact with a target surface, the curvature aids in ejecting debris outside of the footprint of the tool 100 during rotational operation. While the curvature 312 appears to be substantially bell shaped about the center of the abrasive portion 304, the position and symmetry of the curvature 312 is not limiting.

In some embodiments, the curvature 312 exhibits a taper toward the base portion 302. That is the curvature 312 may be greatest at a distal end of the cleaning element and decrease toward the base. In some embodiments, the curvature is a curve in two directions such as along the width and along the length of the abrasive portions such that the curvature is substantially elliptical/spherical. That is, the abrasive portion 304 exhibits a substantially elliptical bulge with a convex surface facing the direction of rotation of the tool 100.

The abrasive portion 304 includes abrasive material 308 provided on a front face of the cleaning element 104 for contacting the floor surface and thereby provide the abrading or cleaning function of the tool 100 when utilized. The abrasive material 308 may include various types of particulate or grit (e.g., diamond grit) of various grit sizes or combinations of grit sizes. In some examples, the abrasive material 308 is brazed onto the front face of the abrasive portion 304 via a brazing material. The cleaning elements 104 may be made of various materials, for example, a spring steel. The abrasive portion 304 includes curvature, for example, curvature may be provided on the cleaning element 104 at least a portion of the abrasive portion 304 where the abrasive material 308 is brazed thereon.

The cleaning elements 104 are mounted within the slots 204 of the base 102 such that they are aligned or oriented along a secant or chord of the base 102 rather than along a radius of the base 102. Thus, the mounting holes provided in the base 102 which correspond with the mounting holes 306 in the mounting portion 302 of the cleaning elements 104 may be positioned so as to orient and align the cleaning elements 104 along the secant or chord rather than a radius of the base 102. In this manner, the cleaning elements 104 are clocked outward (i.e., generally face outward from the peripheral sidewall 202) so as to push (or kick) debris outside of the footprint of the tool 100 during rotational operation of the tool 100.

In particular, the mounting portion 302 of the cleaning element 104 is positioned on the upper surface 108 of the base 102, with the mounting holes 306 in alignment with the corresponding mounting holes in the base 102, and threaded fasteners are utilized to secure the cleaning elements 104 to the base 102, with the abrasive portions 304 of the cleaning elements 104 extending downward through the slots 204 of the base 102. The abrasive portion 304 of the cleaning elements 104 are angled relative to their respective mounting portions 302 such that the abrasive portion 304 is angled with respect to the base 102 generally rearward (away from the direction of rotation) with the abrasive material 308 facing the direction of rotation. With this configuration, a rear face of the cleaning element 104 may contact a rear edge of the slot 204 such that the base 102 provides support to the cleaning element 104 and adds structural rigidity to the cleaning element 104 during use. In addition, the non-planar face of the abrasive portion 304 of the cleaning element 104 may help push debris exterior of the footprint of the tool 100 during use.

In some examples, when the cleaning elements 104 are mounted in the slots 204 of the base 102, an outer edge of the cleaning element may be positioned exterior of the footprint of the base 102. Thus, a majority of the cleaning element 104 will be positioned within the slot 204 in the base 102, while an outer edge or portion of the cleaning elements 104 may be positioned laterally outward of the slot 204 in the base 102.

Various fastening means may be utilized to attach the cleaning elements 104 to the base. In the illustrated example, hex head machine screws 215 and nuts are utilized to secure the cleaning elements 104. The hex head screw 215 extends through the corresponding mounting holes in the cleaning element 104 and the base 102, a serrated washer is provided on each screw at a bottom surface of the base 102 and a nut is provided on each screw over the washer thereon to anchor the cleaning elements 104.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

The terms "proximal" and "distal" are defined herein relative to a user of a floor machine having an interface configured to mechanically couple a tool to a rotary portion of the machine. The term "proximal" refers to the position of an element closer to the user or the rotary portion of the machine and the term "distal" refers to the position of an element further away from user or the rotary portion of the machine. Moreover, the use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

To aid the Patent Office and any readers of this application and any resulting patent in interpreting the claims appended hereto, applicants do not intend any of the appended claims or claim elements to invoke 35 U.S.C. 112(f) unless the words "means for" or "step for" are explicitly used in the particular claim.

What is claimed is:

1. A tool for a floor machine, comprising:

a base having an upper side attachable to the floor machine and a lower side opposite the upper side, and a plurality of slots extending from a periphery of the base inward therefrom along a non-radial secant of the base; and a cleaning element provided within each of the slots, the cleaning elements each having an abrasive portion with abrasive material provided thereon, wherein a portion of the abrasive portion is non-planar to eject debris outside of a footprint of the tool during rotational operation, and wherein the cleaning elements are configured to remove a portion of a previously-coated material.

2. The tool assembly of claim 1, wherein the at least a portion of the abrasive portion has a convex curvature facing a direction of rotation of the tool.

3. The tool assembly of claim 1, wherein the cleaning elements each include a mounting portion attachable to the base and an abrasive portion extending from the mounting portion at an angle.

4. The tool assembly of claim 3, wherein the mounting portion is attached to the upper surface of the base.

5. The tool assembly of claim 3, wherein the abrasive portion is angled relative to the mounting portion at an obtuse angle.

6. The tool assembly of claim 5, wherein the obtuse angle is about 125 degrees.

7. A tool for a floor machine, comprising:

a base having an upper side attachable to the floor machine and a lower side opposite the upper side, and a plurality of slots extending from a periphery of the base inward therefrom towards an interior of the base; and a cleaning element provided within each of the slots, the cleaning elements each having an abrasive portion with abrasive material provided thereon, at least a portion of the abrasive portion being convex in a plane parallel to the lower side of the base, wherein the cleaning elements are configured to remove a portion of a previously-coated material.

8. The tool assembly of claim 7, wherein the slots and the cleaning elements are oriented along a secant of the base.

9. The tool assembly of claim 7, wherein the cleaning elements each include a mounting portion attachable to the base and an abrasive portion extending from the mounting portion at an angle.

10. The tool assembly of claim 9, wherein the mounting portion is attached to the upper surface of the base.

11. The tool assembly of claim 7, wherein the at least a portion of the abrasive portion has a convex curvature facing a direction of rotation of the tool.

12. The tool assembly of claim 7, wherein the at least a portion of the abrasive portion is bell shaped about a center of the abrasive portion.

13. The tool assembly of claim 7, wherein the at least a portion of the abrasive portion includes an elliptical bulge with a convex surface facing the direction of rotation of the tool.

14. The tool assembly of claim 7, wherein the previously-uncoated material is a concrete or cement and comprises one or more of a mastic coating, a plastic coating, and a paint coating, or combinations thereof.

15. A tool for a floor machine, comprising:

a base having an upper side attachable to the floor machine and a lower side opposite the upper side, and a plurality of slots extending from a periphery of the base inward therefrom along a non-radial secant of the base; and a cleaning element provided within each of the slots, the cleaning elements each having an abrasive portion with abrasive material provided thereon, the abrasive portion exhibiting a bell-shaped curvature along a width and a length of the abrasive portion, wherein the cleaning elements are configured to remove a portion of a previously-coated material.

16. The tool assembly of claim 15, wherein the at least a portion of the abrasive portion has a convex curvature facing a direction of rotation of the tool.

17. The tool assembly of claim 16, wherein each cleaning element comprises a planar mounting portion and the abrasive portion extending at an angle from the planar mounting portion.

18. The tool assembly of claim 15, wherein the at least a portion of the abrasive portion is bell shaped about a center of the abrasive portion.

19. The tool assembly of claim 15, wherein the at least a portion of the abrasive portion includes an elliptical bulge with a convex surface facing the direction of rotation of the tool.

* * * * *